US007267501B2

(12) United States Patent
Yang

(10) Patent No.: US 7,267,501 B2
(45) Date of Patent: Sep. 11, 2007

(54) IMAGE FORMING APPARATUS HAVING A PICKUP ROLLER FOR DRIVING A DISCHARGE ROLLER

(75) Inventor: Yong-sok Yang, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/256,097

(22) Filed: Oct. 24, 2005

(65) Prior Publication Data

US 2006/0110204 A1 May 25, 2006

(30) Foreign Application Priority Data

Nov. 23, 2004 (KR) ..... 10-2004-0096156

(51) Int. Cl.
*B41J 11/58* (2006.01)
*B41J 13/10* (2006.01)

(52) U.S. Cl. ..... 400/625; 400/188; 400/659; 400/624; 347/215; 271/3.08

(58) Field of Classification Search ..... 399/388; 400/625, 188, 659, 602, 624; 347/104, 215; 271/3.05, 3.08
See application file for complete search history.

(56) References Cited

U.S. PATENT DOCUMENTS

| | | | | |
|---|---|---|---|---|
| 4,679,953 | A * | 7/1987 | Sone et al. | 400/625 |
| 4,810,120 | A * | 3/1989 | Narita et al. | 400/624 |
| 6,406,201 | B1 | 6/2002 | Beretta et al. | |
| 6,434,359 | B2 * | 8/2002 | Nose et al. | 399/374 |
| 6,511,241 | B2 * | 1/2003 | Fetherolf et al. | 400/664 |
| 6,601,952 | B2 * | 8/2003 | Sugioka et al. | 347/104 |
| 6,733,007 | B2 * | 5/2004 | Sekiyama et al. | 271/65 |
| 2002/0001027 | A1 | 1/2002 | Sugioka | |
| 2003/0030712 | A1 | 2/2003 | Kawaguchi | |
| 2004/0201662 | A1 | 10/2004 | Hwang | |
| 2005/0078996 | A1 * | 4/2005 | Lee | 400/120.17 |

FOREIGN PATENT DOCUMENTS

| | | |
|---|---|---|
| EP | 1 550 559 | 7/2005 |
| JP | 63-092536 | 4/1988 |
| JP | 03-216433 | 9/1991 |
| JP | 06-263273 | 9/1994 |
| JP | 07-081177 | 3/1995 |
| JP | 08-245045 | 9/1996 |
| JP | 10-129881 | 5/1998 |
| JP | 2000-072304 | 3/2000 |
| JP | 2001-071606 | 3/2001 |

(Continued)

*Primary Examiner*—Judy Nguyen
*Assistant Examiner*—Matthew Marini
(74) *Attorney, Agent, or Firm*—Roylance, Abrams, Berdo & Goodman, L.L.P.

(57) ABSTRACT

An image forming apparatus includes an image forming unit that prints an image on a medium. A transport unit transports the medium in a first direction to supply the medium to the image forming unit, and in a second direction for printing. Media is stacked on a paper cassette. A medium supply and discharge unit picks up the medium from the paper cassette to supply the medium to the transport unit, and discharges the medium being transported in the second direction. The transport unit, the paper cassette, and the medium supply and discharge unit are located at the second direction of the image forming apparatus.

20 Claims, 7 Drawing Sheets

FOREIGN PATENT DOCUMENTS

| | | |
|---|---|---|
| JP | 2001-139205 | 5/2001 |
| JP | 2002-051196 | 2/2002 |
| JP | 2002-308500 | 10/2002 |
| KR | 20-1990-21346 | 12/1990 |
| KR | 20-1991-0000842 | 2/1991 |
| KR | 20-1997-0001870 | 3/1997 |
| KR | 1019970003407 | 3/1997 |
| KR | 1020020011048 | 2/2002 |
| KR | 1020040066392 | 7/2004 |

* cited by examiner

IMAGE FORMING APPARATUS HAVING A PICKUP ROLLER FOR DRIVING A DISCHARGE ROLLER

CROSS REFERENCE TO RELATED APPLICATION

This application claims the benefit under 35 U.S.C. § 119(a) of Korean Patent Application No. 10-2004-0096156, filed on Nov. 23, 2004, in the Korean Intellectual Property Office, the entire disclosure of which is hereby incorporated by reference.

BACKGROUND OF THE INVENTION

1. Field of the Invention

The present invention relates to an image forming apparatus that prints an image on one or both sides of a medium while transporting the medium at a predetermined printing speed.

2. Description of the Related Art

An image forming apparatus includes a paper cassette that stores print media, a pickup unit that picks up the media from the paper cassette, a transport unit that transports the media at a predetermined printing speed, an image forming unit that prints an image on the media, and a discharging unit that outputs the printed media. Generally, the pickup unit and the transport unit are located at the entrance portion of the image forming unit and the discharging unit is located at the exit portion of the image forming unit. Widely separating the media transporting units results in a complex power connecting structure that connects the media transporting units, and thus assembling and dismantling of the image apparatus is difficult.

Accordingly, a need exists for an improved image forming apparatus having media transporting units disposed proximal one another to simplify the required power connecting structure.

SUMMARY OF THE INVENTION

The present invention provides an image forming apparatus in which the units that transport media are disposed on one side of an image forming unit, thereby simplifying the power connecting structure of the image forming apparatus.

According to an aspect of the present invention, an image forming apparatus includes an image forming unit that prints an image on a medium. A transport unit transports the medium in a first direction to supply the medium to the image forming unit, and in a second direction to print on the medium. Media is piled or stacked on a paper cassette. A medium supply and discharge unit picks up the medium from the paper cassette to supply the medium to the transport unit, and discharges the medium being transported in the second direction. The transport unit, the paper cassette, and the medium supply and discharge unit are located in the second direction of the image forming apparatus.

According to another aspect, the medium supply and discharge unit includes a pickup roller that picks up the medium from the paper cassette and transports the medium in the first direction to be supplied to the transport unit. A discharge roller contacts the pickup roller. An idle roller discharges the medium being transported in the second direction while meshing with the discharge roller. The discharge roller is installed to rotate with the pickup roller. The medium supply and discharge unit further includes a resistance member that provides rotation resistance to the discharge roller. The discharge roller pivots to a first location away from the idle roller when the pickup roller rotates in the first direction, and to a second location where the discharge roller discharges the medium in the second direction while meshing with the idle roller when the pickup roller rotates in the second direction.

According to another aspect, the resistance member is a tension spring. Ends of the tension spring are respectively connected to the pickup roller and the discharge roller.

According to a further aspect, the medium supply and discharge unit may further include a first frame to which the pickup roller and the discharge roller are coupled, and a second frame coupled to the first frame and to which the idle roller is coupled. A guide element is located between the first and second frames such that the space between the guide element and the first frame forms a pickup path that connects the transport unit to the pickup roller, and the space between the guide element and the second frame forms a discharge path that connects the transport unit to the discharge roller and the idle roller. The guide element is rotatably coupled to the pickup roller. The medium supply and discharge unit may further include a first elastic element that provides elastic force to the guide element so that the guide element may pivot toward the discharge path. The guide element forms the pickup path by being pivoted in the opposite direction to the elastic force of the first elastic element by the medium being transported by the pickup roller. The medium supply and discharge unit may further include a second elastic element that provides elastic force to the idle roller in a direction to move the idle roller toward the discharge roller.

The medium supply and discharge unit may further include a separating element that separates the medium from the media piled on the paper cassette as the medium is picked up. The separating element is coupled to the first frame.

According to still another aspect, the medium is a thermal medium having at least one thermal ink layer. The image forming unit includes a thermal printing head (TPH) that heats the medium to form an image, and a platen roller opposite the TPH to support the medium. The TPH moves to a first print location opposite a first surface of the medium and a second print location opposite a second surface of the medium to print an image at the first print location and the second print location. The TPH rotates with a rotation axis of the platen roller as a pivot to move between the first and second print locations.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

The present invention will now be described more fully with reference to the accompanying drawings, in which exemplary embodiments of the invention are shown.

Figure 1:
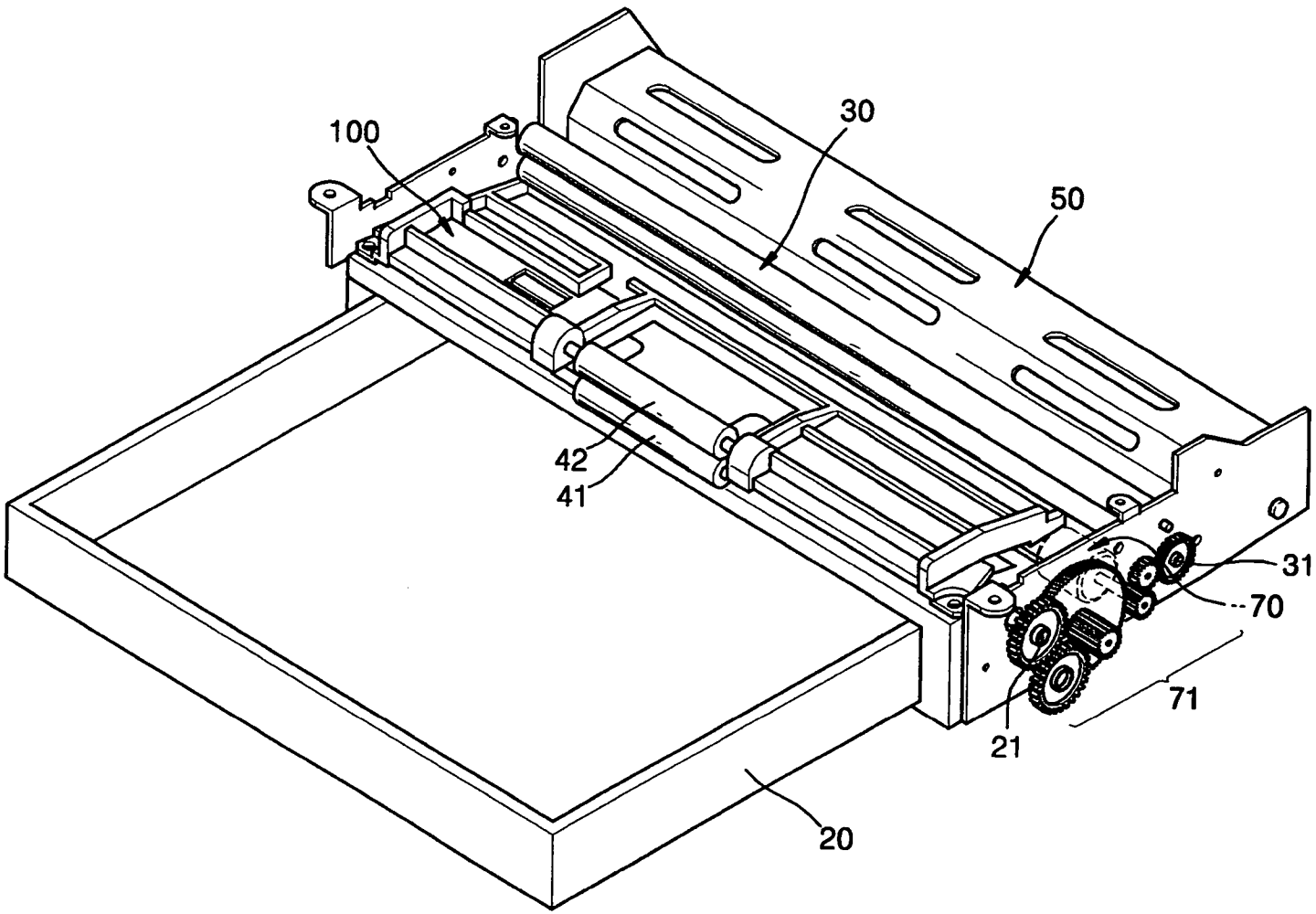
FIG. 1 is a perspective view of an image forming apparatus according to an exemplary embodiment of the present invention.
Figure 2:
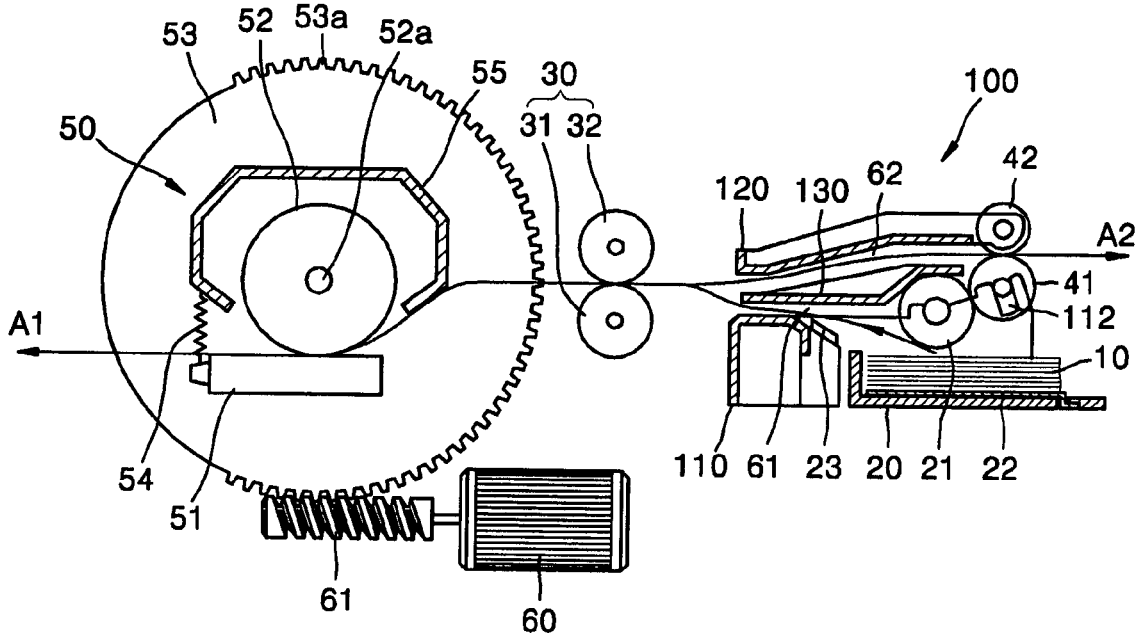
FIG. 2 is an elevational view in cross-section of the image forming apparatus of FIG. 1.

FIG. 1 is a perspective view of an image forming apparatus according to an exemplary embodiment of the present invention. FIG. 2 is an elevational view in cross-section of the image forming apparatus of FIG. 1. In an exemplary embodiment, the image forming apparatus is a thermal-type image forming apparatus that prints an image by applying heat to a medium having a thermal ink layer. Referring to FIGS. 1 and 2, the image forming apparatus includes an image forming unit 50, a transport unit 30, a paper cassette 20, and a medium supply and discharge unit 100.

The image forming unit 50 includes a thermal printing head (TPH) 51 and a platen roller 52 disposed opposite the TPH 51 to support a medium 10. The TPH 51 and the platen roller 52 are elastically biased toward one another by an elastic element 54. The transport unit 30 transports the medium 10 in a first direction A1 to supply the medium 10 to the image forming unit 50, or in a second direction A2 for printing. The transport unit 30 includes, for example, a transport roller 31 and an idle roller 32 that meshes with the transport roller 31. The medium 10 is piled or stacked in the paper cassette 20. The medium supply and discharge unit 100 picks up the medium from the paper cassette 20 and supplies it to the transport unit 30, and discharges the medium 10 that is transported in the second direction A2 by the transport unit 30. The medium supply and discharge unit 100 includes a pickup roller 21 placed on top of the paper cassette 20, a discharge roller 41 that rotates in contact with the pickup roller 21, and an idle roller 42 that rotates in contact with the discharge roller 41. The transport unit 30 is connected to the pickup roller 21 via a pickup path 61, and to the discharge roller 41 and the idle roller 42 via a discharge path 62. The pickup roller 21 and the transport roller 31 are connected to a driving motor 70 through a plurality of gears 71. The transport unit 30, the paper cassette 20, and the medium supply and discharge unit 100 are located in the second direction A2 from the image forming unit 50.

Figure 3:
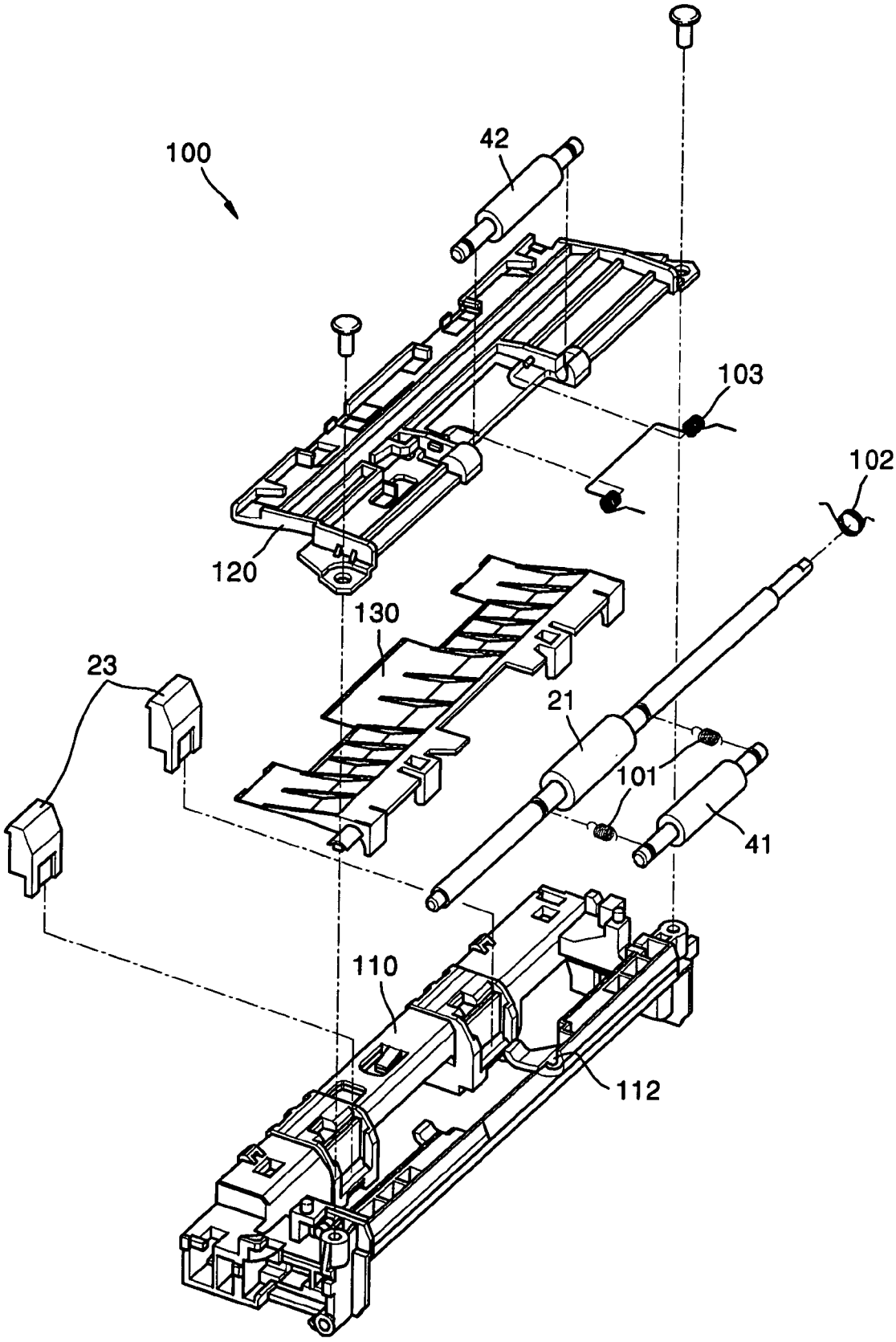
FIG. 3 is an exploded perspective view of a medium supply and discharge unit of FIGS. 1 and 2.

FIG. 3 is an exploded perspective view of the medium supply and discharge unit 100. Referring to FIG. 3, the medium supply and discharge unit 100 further includes first and second frames 110 and 120, and a guide element 130. The pickup roller 21 is rotatably coupled to the first frame 110. The discharge roller 41 is rotatably coupled to a guide groove 112 provided in the first frame 110. The guide groove 112 may be a circular arc concentric with the pickup roller 21 so that the discharge roller 41 may rotate about the center of the pickup roller 21. A pair of tension springs 101 couple the discharge roller 41 to the pickup roller 21. Although it will be described later in more detail, the tension springs 101 are used as resistance members that provide rotation resistance to the discharge roller 41, so that the discharge roller 41 may swing to a first location away from the idle roller 42 or a second location in contact with the idle roller 42, according to the rotation direction of the pickup roller 21.

The second frame 120 is coupled to the first frame 110. The idle roller 42 is rotatably coupled to the second frame 120. A torsion spring 103, which is a second elastic element, exerts a force on the idle roller 42 towards the discharge roller 41.

The guide element 130 is located between the first and second frames 110 and 120. The guide element 130 is rotatably coupled to the pickup roller 21. One end of a torsion spring (a first elastic element) 102 is supported by the first frame 110, and the other end of the torsion spring 102 presses the guide element 130. The space between the guide element 130 and the first frame 110 forms the pickup path 61, and the space between the guide element 130 and the second frame 120 forms the discharge path 62. The guide element 130 is elastically biased by the torsion spring 102 so that it pivots toward the direction where the discharge path 62 is formed.

Separating elements 23 may be formed on the first frame 110 to separate the medium 10 from the rest of the media in the paper cassette 20. The separating elements 23 provide friction to the media so that the pickup roller 21 picks up only the top medium 10 and supplies it to the transport unit 30.

Figure 4:
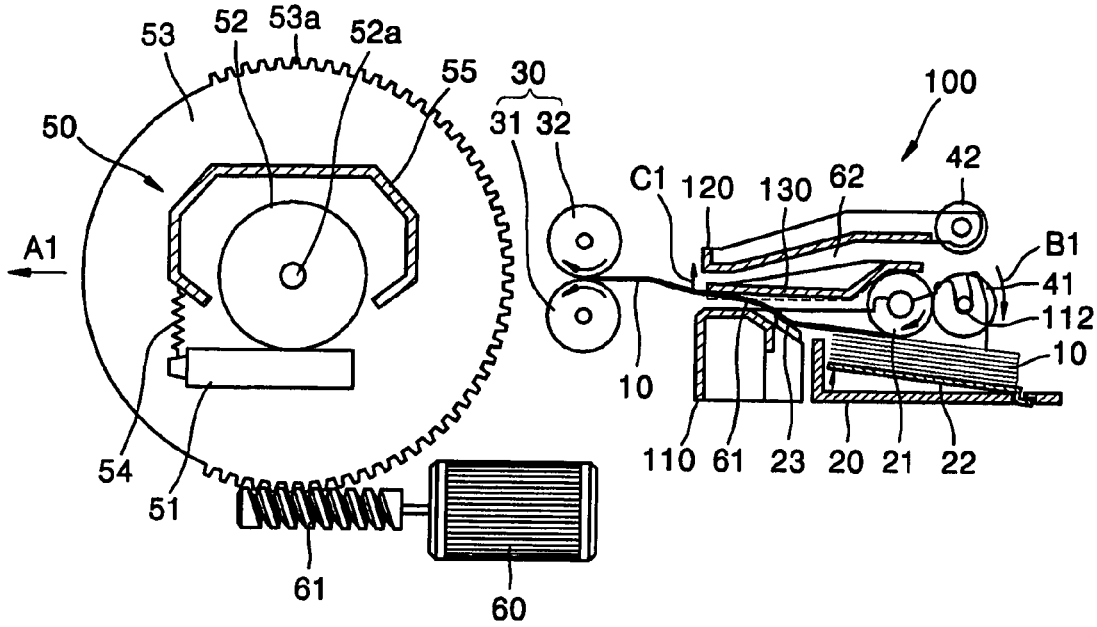
FIGS. 4 through 6 are elevational views in cross-section of the image forming apparatus illustrating the process of printing an image on a first surface of a medium.

In a process of forming an image with the image forming apparatus having the above structure, a driving unit (not shown) raises a knock-up plate 22 so that the media piled on the knock-up plate 22 comes in contact with the pickup roller 21, as illustrated in FIG. 4. The driving motor 70 rotates clockwise and rotates the pickup roller 21 and the transport unit 30 in the first direction A1. The tension springs 101 provide rotation resistance to the discharge roller 41, which interferes with the rotation of the discharge roller 41. Therefore, when the pickup roller 21 rotates in the first direction A1, the discharge roller 41 does not rotate. Instead, the discharge roller 41 swings in a direction B1 according to the guide groove 112, to finish at a first location away from the idle roller 42. The discharge roller 41 cannot swing further once it reaches the end of the guide groove 112, so it then begins to rotate at its first location. Generally, a plurality of media is picked up when the pickup roller 21 rotates in the first direction A1. Only the single medium 10 is separated from the rest the media by the separating element 23, and is transported through the pickup path 61. When the pickup process is completed, the driving unit lowers the knock-up plate 22, and the pile of media is separated from the pickup roller 21. The guide element 130 is elastically biased by the torsion spring 102 toward the direction of the discharge path 62. The medium 10 pushes the guide element 130 to pivot it slightly in a direction C1 illustrated in FIG. 4, as it is supplied to the transport unit 30.

Figure 5:
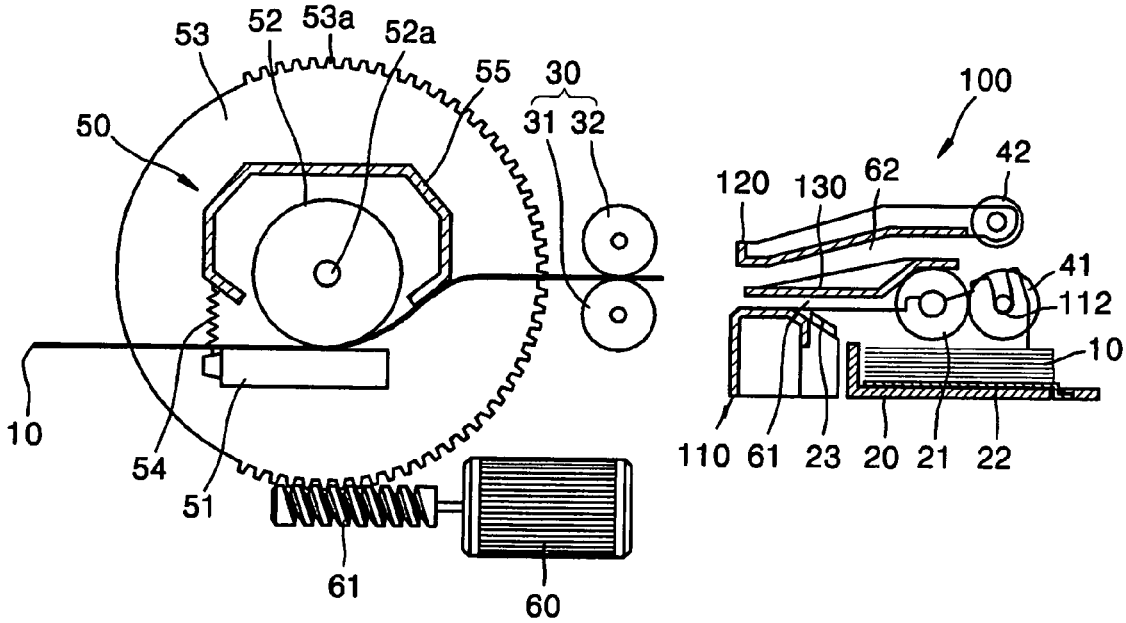
Figure 6:
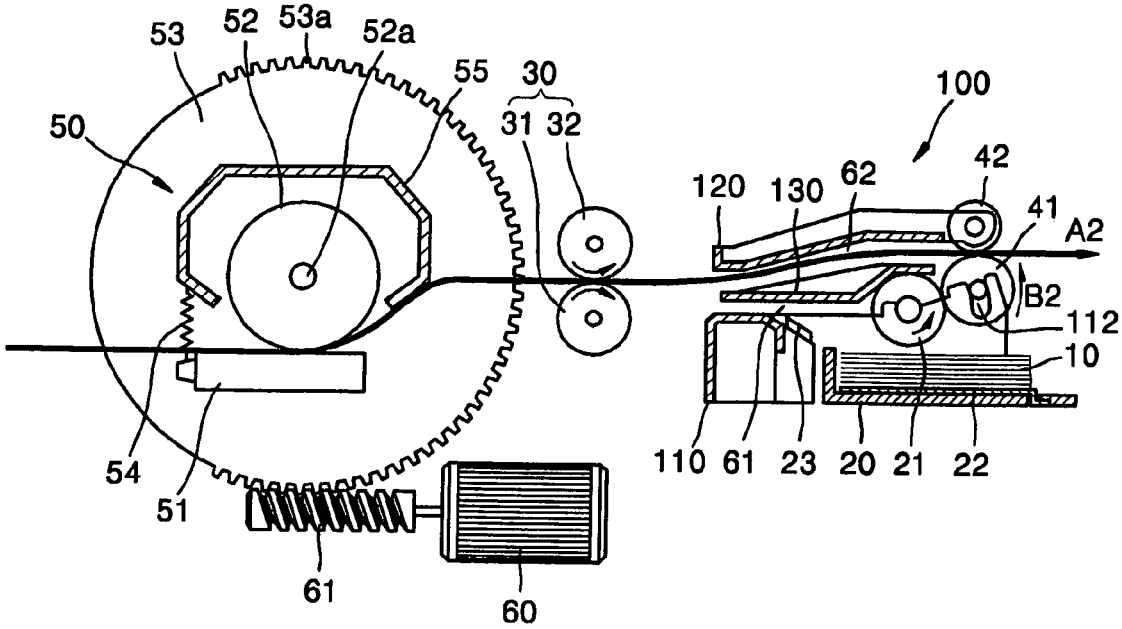

The transport unit 30 transports the medium 10 in the first direction A1 between the TPH 51 and the platen roller 52. After the trailing end of the medium 10 passes the guide element 130, the guide element 130 returns to the location that forms the discharge path 62 by the elastic force of the torsion spring 102. As illustrated in FIG. 5, the driving motor 70 stops before the trailing end of the medium 10 passes through the transport unit 30. The medium 10 is then placed at a predetermined print start location. The driving motor 70 rotates in the counter-clockwise direction and rotates the pickup roller 21 and the transport unit 30 in the second direction A2, as illustrated in FIG. 6. The TPH 51 heats the medium 10 being transported in the second direction A2 to print an image thereon. The medium 10 is discharged along the discharge path 62. Even though the pickup roller 21 rotates in the second direction A2, the discharge roller 41 does not at first rotate, due to the rotation resistance provided by the tension springs 101. Instead, the discharge roller 41 swings in a direction B2 according to the guide groove 112 to finish at a second location in contact with the idle roller 42, as illustrated in FIG. 6. After the discharge roller 41 contacts the idle roller 42, it stops swinging and begins to rotate in the second direction A2 in contact with the idle roller 42. The discharge roller 41 and the idle roller 42 are pressed together by the torsion spring 103, to discharge the medium 10 along the discharge path 62 after being printed.

According to the image forming apparatus having the above described structure, the transport unit 30 and the medium supply and discharge unit 100 are both located in the second direction A2 from the center of the image forming apparatus. Additionally, the discharge roller 41 and the idle roller 42 are selectively driven according to the rotation direction of the pickup roller 21. Therefore, the driving motor 70 needs only to drive the transport unit 30 and pickup roller 21, allowing the use of a simple power connecting structure to connect the driving motor 70 to the transport unit 30 and the medium supply and discharge unit 100. Furthermore, the medium supply and discharge unit 100 is modularized, as illustrated in FIG. 3, to allow easy assembly and dismantling, and the assembly process of the image forming apparatus is thereby simplified.

Figure 7:
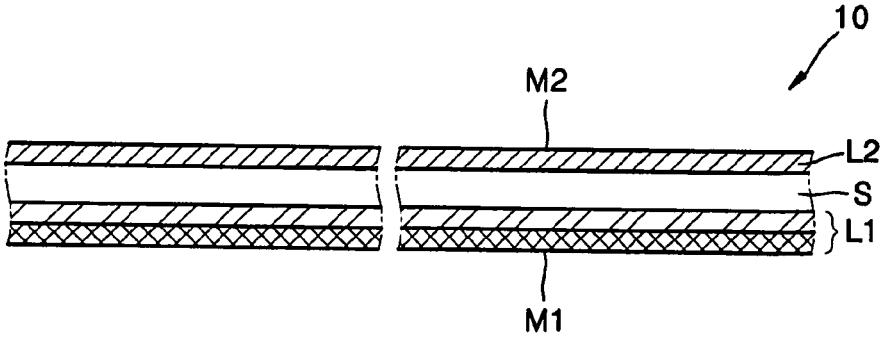
FIG. 7 is an elevational view in cross-section of the medium.

The medium 10 used in the image forming apparatus of the present embodiment may have the structure illustrated in FIG. 7. The medium includes thermal ink layers L1 and L2 respectively formed on first and second surfaces M1 and M2 of a base sheet S, to produce predetermined colors by reacting to heat. The thermal ink layers L1 and L2 may have a single layer structure to produce a single color, or a multi-layer structure to produce multiple colors. As an example, the thermal ink layer L1 may include two layers to produce yellow and magenta, and the thermal ink layer L2 may include a single layer to produce cyan. The yellow and magenta of the thermal ink layer L1 may be selectively produced according to the temperature and heating time of the TPH 51. For example, yellow is produced when the medium 10 is heated a short time at a high temperature, and magenta is produced when the medium 10 is heated for a long time at a low temperature, or vice versa. If the base sheet S is transparent and yellow, magenta, and cyan may all be produced, obtaining a color image is possible through the superimposition of yellow, magenta, and cyan. Such a medium 10 is disclosed in U.S. Patent Publication No. 2003-0125206. If the base sheet S is opaque, different images may be formed on the first and second surfaces M1 and M2. The technical scope of the method of forming an image is not limited by the structure of the thermal ink layers L1 and L2 of the first and second surfaces M1 and M2 of the medium 10.

Figure 8:
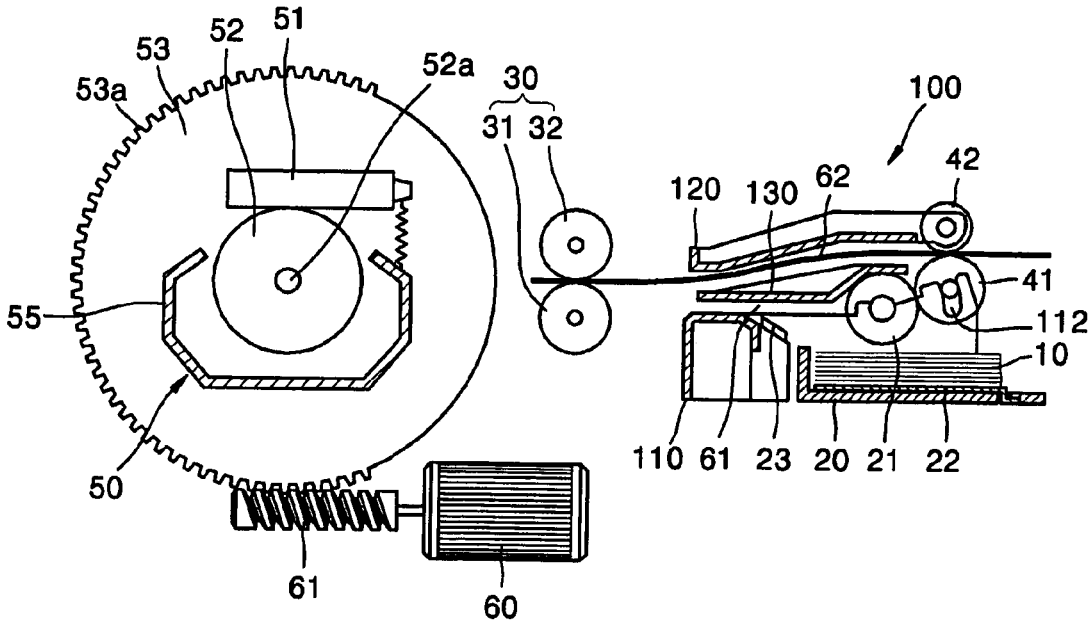
FIG. 8 is an elevational view in cross-section illustrating a thermal printing head (TPH) located at a second print location.

The TPH 51 may move between a first print location (see FIG. 2) opposite the first surface M1 of the medium 10 and a second print location (see FIG. 8) opposite the second surface M2 of the medium 10, to heat both the first and second surfaces M1 and M2 of the medium 10. In an exemplary embodiment of the image forming apparatus, the TPH 51 rotates with a rotation axis 52*a* of the platen roller 52 as a pivot to move between the first and second print locations. An example of the structure to move the TPH 51 to the first and second print locations is illustrated in FIGS. 2 and 8. Referring to FIGS. 2 and 8, a support bracket 53 that rotates concentrically with the rotation axis 52*a* of the platen roller 52 is illustrated. The TPH 51 is coupled to the support bracket 53. A gear 53*a* is provided on the outer circumference of the support bracket 53. A worm gear 61 that meshes with the gear 53*a* is formed on a rotation axis of a motor 60. According to such a structure, the support bracket 53 is rotated by the motor 60, thereby moving the TPH 51 between the first and second print locations. A medium guide 55 is coupled to the support bracket 53 to guide the medium 10 between the TPH 51 and the transport unit 30. The structure to move the TPH 51 to the first and second print locations is not limited to the example provided in FIGS. 2 and 8. Additionally, the scope of the present invention is not limited to the structure for moving the TPH 51 to the first and second print locations.

Figure 9:
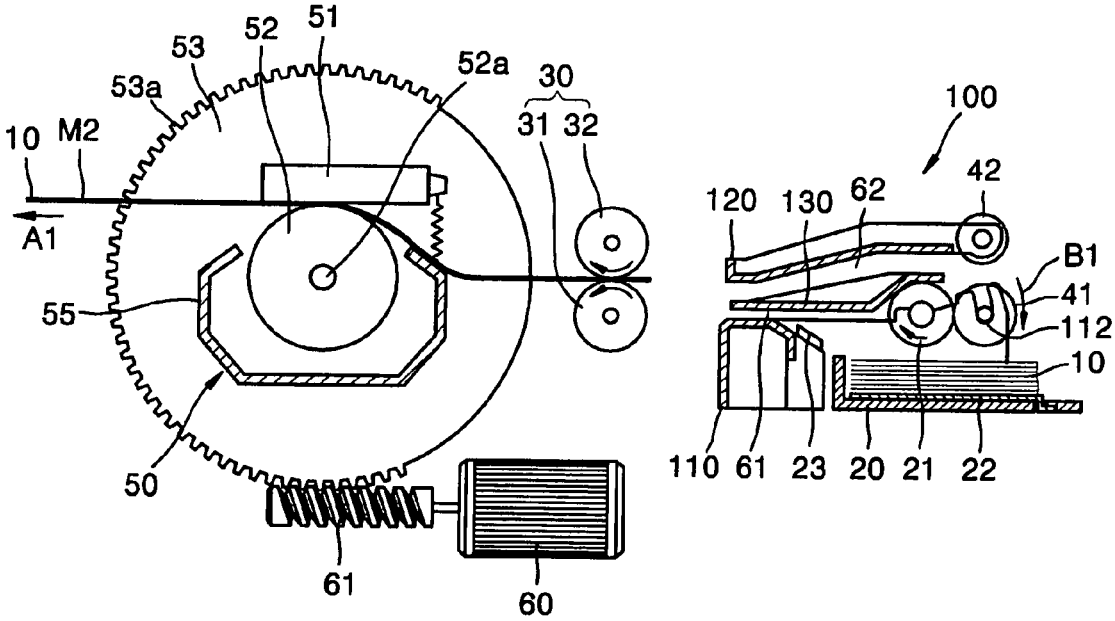
FIGS. 9 and 10 are elevational views in cross-section of the image forming apparatus illustrating the process of printing an image on a second surface of the medium.
Figure 10:
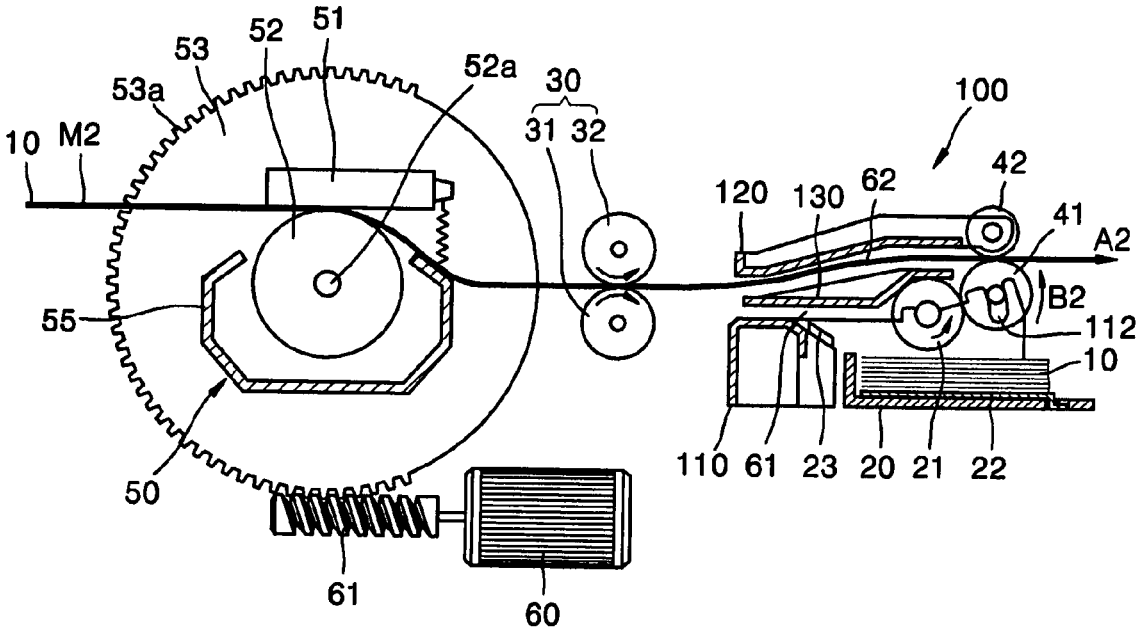

The yellow and magenta parts of an image are printed on the first surface M1 of the medium 10 according to a printing order illustrated in FIGS. 4 through 6. After the printing on the first surface M1 is completed, the driving motor 70 stops before the first end of the medium passes through the transport unit 30. The motor 60 rotates the support bracket 53 to move the TPH 51 to the second print location, as illustrated in FIG. 8. The driving motor 70 rotates in the clockwise direction again, and the transport unit 30 and the pickup roller 21 rotate in the first direction A1, as illustrated in FIG. 9. When the pickup roller 21 rotates in the first direction A1, the discharge roller 41 swings in the direction B1 to the first location away from the idle roller 42. The transport unit 30 transports the medium 10 in the first direction A1 and supplies the medium 10 between the TPH 51 and the platen roller 52. The medium 10 is then located at the same print start location as when printing on the first surface M1. The driving motor 70 rotates in the opposite direction and the transport unit 30 and the pickup roller 21 rotate in the second direction A2, as illustrated in FIG. 10. The TPH 51 supplies heat to the second surface M2 being transported in the second direction A2 to print an image. The medium 10 is then discharged along the discharge path 62. When the pickup roller 21 rotates in the second direction A2, the discharge roller 41 swings in the direction B2 according to the guide groove 112 to the second location in contact with the idle roller 42. The discharge roller 41 rotates in contact with the idle roller 42 to discharge the medium 10 along the discharge path 62.

According to the above-described image forming apparatus of the present invention, a power connecting structure that connects a driving motor, a transport unit that transports a medium, and a medium supply and discharge unit may be simplified by installing the transport unit and the medium supply and discharge unit on only one side of the image forming apparatus. Additionally, the power connecting structure may be further simplified by selectively driving a discharge roller according to the rotation direction of a pickup roller. Furthermore, the medium supply and discharge unit is modularized to allow easy assembly and dismantling, and the assembly process of the image forming apparatus may be simplified.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus, comprising:

an image forming unit that prints an image on a medium;

a transport unit that transports the medium in a first direction to supply the medium to the image forming unit and in a second direction to print on the medium;

a paper cassette on which media is stacked;

a medium supply and discharge unit that picks up the medium from the paper cassette to supply the medium to the transport unit and that discharges the medium being transported in the second direction;

a pickup roller that picks up the medium from the paper cassette and transports the medium in the first direction to be supplied to the transport unit; and a discharge roller that contacts the pickup roller;

wherein the transport unit, the paper cassette, and the medium supply and discharge unit are located on the same side of the image forming apparatus.

2. The image forming apparatus of claim 1, wherein the medium supply and discharge unit includes an idle roller that discharges the medium being transported in the second direction when meshing with the discharge roller.

3. The image forming apparatus of claim 2, wherein the discharge roller is installed to be able to pivot about the pickup roller; and the medium supply and discharge unit includes a resistance member that provides rotational resistance to the discharge roller such that the discharge roller pivots to a first location away from the idle roller when the pickup roller is rotating in the first direction, and the discharge roller pivots to a second location to discharge the medium in the second direction while meshing with the idle roller when the pickup roller is rotating in the second direction.

4. The image forming apparatus of claim 3, wherein the resistance member is a tension spring and a first end of the tension spring is connected to the pickup roller and a second end of the tension spring is connected to the discharge roller.

5. The image forming apparatus of claim 3, wherein the medium supply and discharge unit includes a first frame to which the pickup roller and the discharge roller are coupled;

a second frame coupled to the first frame and to which the idle roller is coupled; and a guide element located between the first and second frames such that a first space between the guide element and the first frame forms a pickup path that connects the transport unit to the pickup roller, and a second space between the guide element and the second frame forms a discharge path that connects the transport unit to the discharge roller and the idle roller.

6. The image forming apparatus of claim 5, wherein the guide element is rotatably coupled to the pickup roller, and the medium supply and discharge unit includes a first elastic element that provides elastic force to the guide element such that the guide element pivots toward the discharge path, and the guide element forms the pickup path by being pivoted in the opposite direction to the elastic force of the first elastic element by the medium being transported by the pickup roller.

7. The image forming apparatus of claim 3, wherein the medium supply and discharge unit includes a second elastic element that provides elastic force to the idle roller in a direction such that the idle roller is biased toward the discharge roller.

8. The image forming apparatus of claim 3, wherein the medium supply and discharge unit includes a separating element that separates the medium from the media piled on the paper cassette as the medium is picked up, and the separating element is coupled to the first frame.

9. The image forming apparatus of claim 1, wherein the medium is a thermal medium having at least one thermal ink layer.

10. The image forming apparatus of claim 9, wherein the image forming unit includes a thermal printing head that heats the medium to form an image, and a platen roller disposed opposite the thermal printing head to support the medium.

11. The image forming apparatus of claim 10, wherein the thermal printing head moves between a first print location opposite a first surface of the medium and a second print location opposite a second surface of the medium to print an image at the first print location and at the second print location.

12. The image forming apparatus of claim 11, wherein the thermal printing head rotates between first and second print locations about a rotational axis of the platen roller.

13. An image forming apparatus, comprising:

an image forming unit adapted to print an image on a medium;

a transport unit that transports the medium in a first direction to supply the medium to the image forming unit and in a second direction to print on the medium, the transport unit having a transport roller driven by a motor;

a paper cassette on which media is stacked;

a pickup roller of a medium supply and discharge unit that picks up the medium from the paper cassette to supply the medium in the first direction to the transport unit and that discharges the medium being transported in the second direction, the pickup roller being driven by the motor; and a discharge roller of the medium supply and discharge unit that is driven by the pickup roller to discharge the medium.

14. The image forming apparatus of claim 13, wherein the transport unit, the paper cassette, and the medium supply and discharge unit are located on the same side of the image forming unit.

15. The image forming apparatus of claim 14, wherein an idle roller discharges the medium being transported in the second direction when meshing with the discharge roller.

16. The image forming apparatus of claim 15, wherein the discharge roller pivots about the pickup roller; and a resistance member connected to the discharge roller provides rotational resistance such that the discharge roller pivots to a first location away from the idle roller when the pickup roller is rotating in the first direction, and the discharge roller pivots to a second location to discharge the medium in the second direction while meshing with the idle roller when the pickup roller is rotating in the second direction.

17. The image forming apparatus of claim 16, wherein the resistance member is a tension spring, a first end of the tension spring being connected to the pickup roller and a second end of the tension spring being connected to the discharge roller.

18. The image forming apparatus of claim 15, wherein a second elastic element is connected to the idle roller to provide an elastic force that biases the idle roller toward the discharge roller.

19. The image forming apparatus of claim 14, wherein a guide element is rotatably coupled to the pickup roller, the guide element being pivotable between a first position to provide a pickup path between the transport unit and the pickup roller, and a second position to provide a discharge path between the transport unit and the discharge roller, the guide element being pivoted by rotation of the pickup roller.

20. The image forming apparatus of claim 19, wherein a first elastic element is connected to the pickup roller to provide an elastic force to the guide element such that the guide element pivots between first and second positions by rotation of the pickup roller.

* * * * *